US005423282A

United States Patent [19]

Krull et al.

[11] Patent Number: 5,423,282

[45] Date of Patent: Jun. 13, 1995

[54] SIGNAL FOR INDICATING LOCATION OF FLOATING PERSON

[76] Inventors: Mark A. Krull, 7932 Somerset Rd., Woodbury, Minn. 55125; Kristine M. Schlagenhauf, 2144 Dodge Ave., Fort Wayne, Ind. 46805

[21] Appl. No.: 209,702

[22] Filed: Mar. 10, 1994

[51] Int. Cl.[6] ..... G09F 17/00

[52] U.S. Cl. ..... 116/209; 116/173; 441/89

[58] Field of Search ..... 116/173, 63 P, 209; 40/603; 441/89; 224/186, 190, 250, 901

[56] References Cited

U.S. PATENT DOCUMENTS

| | | | |
|---|---|---|---|
| 1,256,488 | 2/1918 | Smith | 441/89 |
| 2,244,163 | 6/1941 | Kronhaus | 9/20 |
| 3,371,647 | 3/1968 | Shopbell | 116/209 |
| 3,638,258 | 2/1972 | Black | 9/321 |
| 4,026,236 | 5/1977 | Robbins | 116/124 R |
| 4,035,856 | 7/1977 | Oberg | 9/313 |
| 4,498,615 | 2/1985 | Johnson | 224/901 X |
| 4,599,965 | 7/1986 | Johnson | 116/209 |
| 4,725,252 | 2/1988 | McNeil | 441/89 |
| 4,752,264 | 6/1988 | Melendez et al. | 441/89 |
| 4,796,553 | 1/1989 | Cogswell et al. | 116/173 |
| 4,807,557 | 2/1989 | Lodisio | 116/173 |
| 4,813,369 | 3/1989 | Moreland | 116/173 |
| 5,029,551 | 7/1991 | Rosen | 116/209 |
| 5,083,956 | 1/1992 | Chraghcian et al. | 441/89 |

FOREIGN PATENT DOCUMENTS

| | | | |
|---|---|---|---|
| 0344811 | 11/1936 | Italy | 40/586 |
| 0211395 | 12/1940 | Switzerland | 224/186 |
| 0009600 | of 1892 | United Kingdom | 40/586 |

*Primary Examiner*—William A. Cuchlinski, Jr.
*Assistant Examiner*—Willie Morris Worth

[57] ABSTRACT

The present invention provides a signal device of a type worn by a person while engaging in a water activity in order to indicate the location of the person in the water. The signal device includes at least one belt that may form a part of or be secured to a variety of flotation devices, or that may be secured directly about a person's torso. At least one upright or mast extends upward from the belt to an upper end above a shoulder of the person. A flag or other "attention getter" is secured to the upper end of the upright in order to enhance visibility of the person to whom the signal device is secured.

20 Claims, 7 Drawing Sheets

SIGNAL FOR INDICATING LOCATION OF FLOATING PERSON

FIELD OF THE INVENTION

The present invention relates to a signal for indicating the location of a person floating in water.

BACKGROUND OF THE INVENTION

Others have recognized and addressed the need to enhance the visibility of a person floating in water. For example, see U.S. Pat. No. 5,083,956 to Chraghchian et al., U.S. Pat. No. 4,752,264 to Melendez et al., and U.S. Pat. No. 4,035,856 to Oberg. Each of these patents is primarily concerned with the risk of injury to water skiers when they are down in the water, as opposed to up on the water. However, the need for enhanced visibility in the water is of a more general nature, and water skiing is simply one well recognized application for such inventions. For example, another application for such devices is to enhance the visibility of children swimming at crowded places, such as public beaches.

Each of the above-identified patents helps to signal the location of a person floating in water, but none discloses a signal device that is relatively simple in construction, relatively easy to secure to a conventional flotation device, and relatively comfortable in use. One particular problem that is common to all of the known devices is the discomfort caused by the location of the tube/mast/staff directly behind the skier's spine and head. Another common problem is the discomfort and potential for injury due to the relatively hard, rigid composition of the tube/mast/staff.

An object of the present invention is to provide a new and improved signal device for enhancing the visibility of a person floating in water.

Another object of the present invention is to provide a signal device that is safe and comfortable in use.

Another object of the present invention is to provide a signal device that is simple in construction and cost effective to manufacture and distribute.

Another object of the present invention is to provide a signal device that is easily secured to a wide range of conventional flotation devices and reliable in use.

Additional objects of the present invention will become apparent from the description that follows.

SUMMARY OF THE INVENTION

The present invention provides a signal device of a type worn by a person while engaging in a water activity in order to indicate the location of the person in the water. The signal device includes at least one belt that may form a part of or be secured to a variety of flotation devices, or that may be secured directly about a person's torso. At least one upright or mast extends upward from the belt to an upper end above a shoulder of the person. A flag or other "attention getter" is secured to the upper end of the upright in order to enhance visibility of the person to whom the signal device is secured. Many of the advantages of the present invention will become apparent upon a more detailed description of the invention.

BRIEF DESCRIPTION OF THE DRAWING

With reference to the Figures, wherein like numerals represent like parts and assemblies throughout the several views.

DETAILED DESCRIPTION OF A PREFERRED EMBODIMENT

Figure 1:
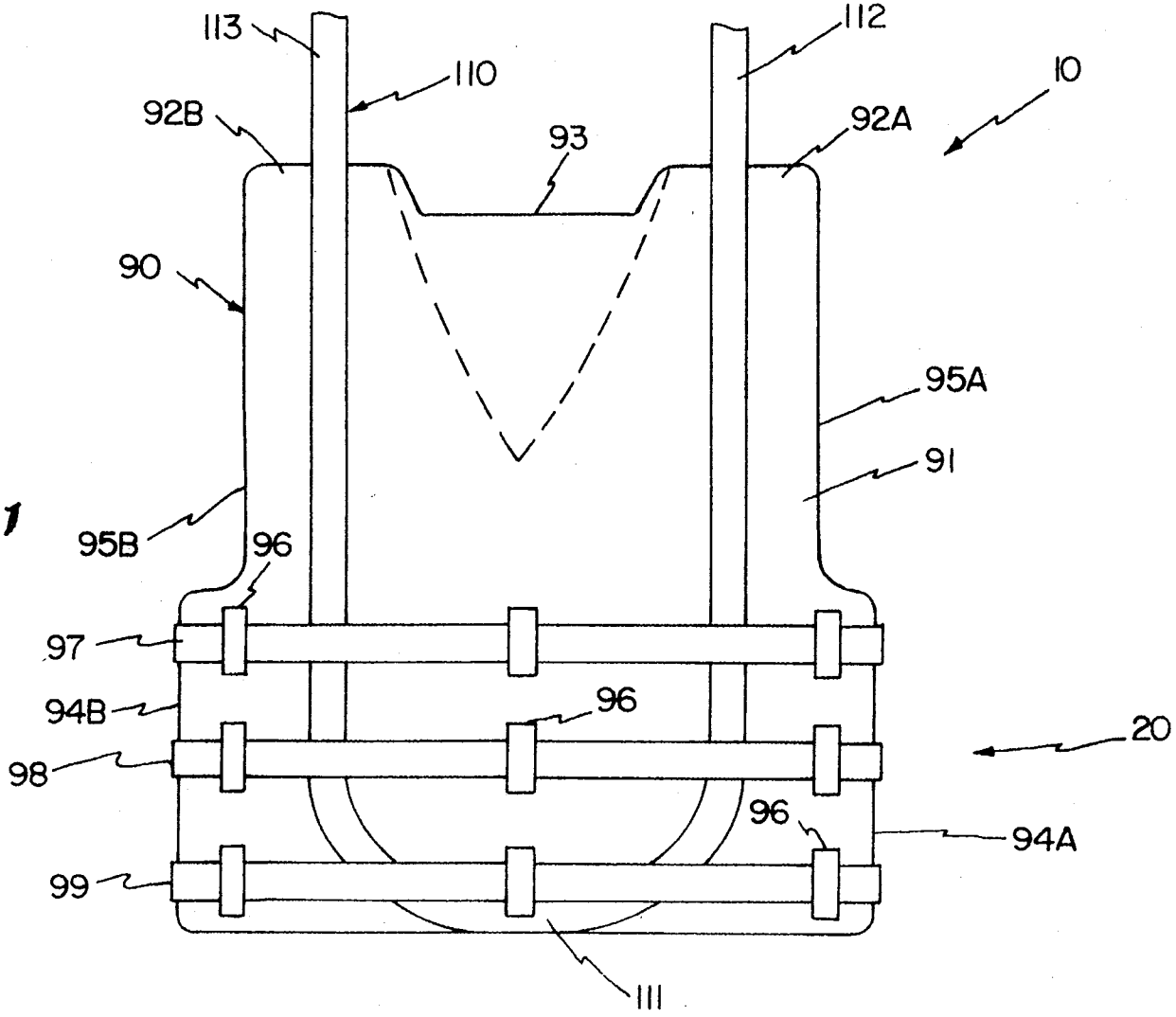
FIG. 1 is a rear view of a signal device constructed according to the principles of the present invention.
Figure 7:
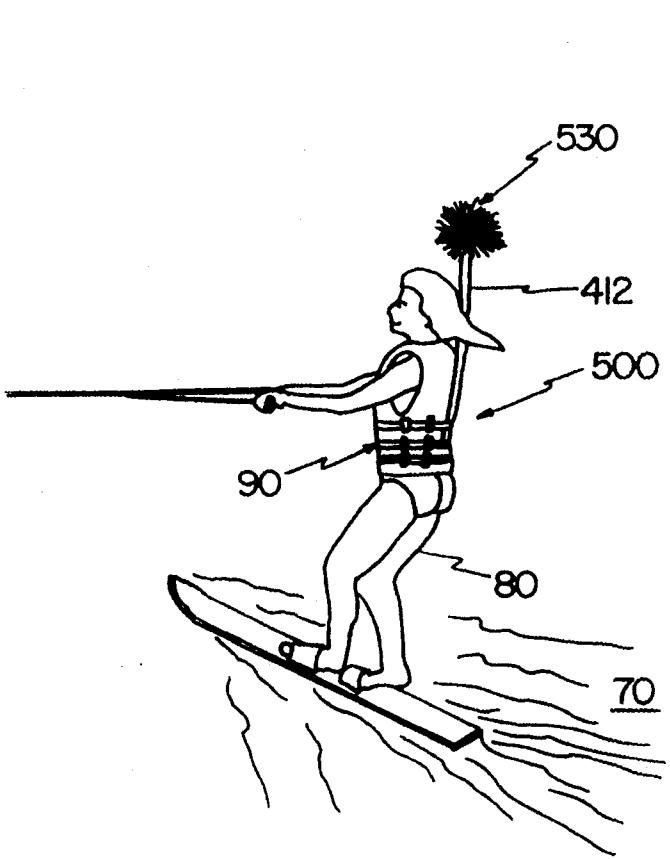
FIG. 7 is a perspective view of a water skier down in the water and wearing the signal device shown in FIG. 1.

A signal device constructed according to the principles of the present invention is designated as 10 in FIGS. 1 and 7. The signal device 10 generally includes a substantially U-shaped member 110 connected to an otherwise conventional flotation vest 90 of a type worn by water skiers and persons engaged in other types of water activities. The U-shaped member 110 is secured to the vest 90 in such a manner that upwardly extending portions 112 and 113 of the U-shaped member 110 extend upward above the skier's shoulders, on opposite sides of the skier's head. As shown in FIG. 7, a flag or other visibility enhancing means 130 is secured to one or both of the upwardly extending portions 112 and 113 to enhance the visibility of the skier 80 when he or she is down in the water 70.

An advantage of the present invention is the location of the upwardly extending portions or uprights relative to the skier's spine and head. In particular, the uprights are less likely to cause discomfort because they are not aligned with the skier's spine or head. Thus, the uprights engage the fleshy portions of the skier's back, rather than the bony spine, and to the extent that the uprights move back and forth in use, they will not strike the back of the skier's head. This improvement is particularly significant in view of the fact that the uprights on Prior Art devices were made of relatively hard plastic or fiberglass.

With reference to FIG. 1, the otherwise conventional vest 90 has a substantially flat back portion 91, the upper part of which is sized to fit within the shoulder span of a skier. The back portion 91 extends upward to a neck opening 93 disposed between a pair of shoulder straps **92*a* and 92*b*. The neck opening 93 accommodates insertion of the skier's head, thereby allowing the shoulder straps 92*a* and 92*b* to rest upon the skier's shoulders. Opposite side portions 94*a* and 94*b* extend from opposite sides of the lower part of the back portion 91 and wrap around the skier's torso. The opposite sides of the upper part of the back portion 91 terminate to provide openings 95*a* and 95*b* through which the skier's arms extend. Three lateral straps 97–99 extend around the side portions 94***a* and 94*b* and the lower part of the back portion 91 of the vest 90, passing through loops 96 that are secured to the vest 90. The straps 97–99 extend around to the front of the vest 90, and the opposite ends of each strap are selectively fastened to one another to secure the vest 90 about a skier. Although the particular closure mechanisms are not shown, those skilled in the art will recognize that buckles or the like are typically used to selectively secure each of the straps 97–99 into a tight, closed loop about the torso engaging portion of the vest 90.

In this embodiment 10, the lateral straps 97–99 provide a means 20 for securing the U-shaped member 110 to the vest 90. In particular, when the straps 97–99 are unfastened or at least loosened relative to the vest 90, the upwardly extending members or uprights 112 and 113 can be inserted between the vest back 91 and one or more of the straps 97–99. For maximum support, the uprights 112 and 113 are disposed on opposite sides of at least one loop 96 and inserted first through the lowermost strap 99, then through the middle strap 98, and then through the uppermost strap 97. The upwardly extending members 112 and 113 are subsequently moved further upward until resistance is encountered as a transverse portion 111 of the U-shaped member 110 approaches a lowermost loop disposed between the uprights 112 and 113. With the upwardly extending members 112 and 113 extending on opposite sides of the neck opening 93 and approximately parallel to one another, a person puts on the vest and fastens each of the straps 97–99 into a tight, closed loop about the torso engaging portion of the vest 90. The straps 97–99 secure the U-shaped member 110 to the vest 90, and the vest 90 to the person. Those skilled in the art will recognize that the present invention would function in much the same manner if stitching were substituted for the loops, so long as the straps were sewn to the vest only at discrete locations with intervals therebetween.

As shown in FIG. 7, each of the upwardly extending members 112 and 113 extends upward behind a respective shoulder of the skier 80 to a respective distal end well above the skier's head. A visibility enhancing means 130 (in this embodiment, a flag) extends between the distal end 114 of the right upright 112 and the distal end 115 of the left upright 113. The flag 130 enhances the visibility of the downed skier 80, and the interconnection of the distal ends 114 and 115 enhances the structural integrity of the uprights 112 and 113. The flag 130 is secured to the uprights 112 and 113 by means of hook and loop fasteners. As a result, the flag 130 can be removed when a need arises to attach or detach the U-shaped member 110 to or from the vest 90. If the flag 130 were not selectively removable, then one would either have to partially remove the straps 97–99 in order to attach the U-shaped member 110 to the vest 90, or insert the uprights 112 and 113 through the straps 97–99 without any loops disposed therebetween. Alternatively, a separate flag may be secured to each of the uprights 112 and 113, in which case the invention provides a useful redundancy in the event that one of the uprights fails and/or is removed. In other words, a single upright is sufficient to support an visibility enhancing means.

The lateral portion or intermediate member 111 integrally connects the lower ends of the first and second upwardly extending members 112 and 113 and extends downward in an arc therebetween. The U-shaped member 110 is a single piece of semi-rigid foam that is molded into the shape shown in FIG. 1. Those skilled in the art will recognize that various suitable materials are available for construction of the U-shaped member. However, the use of semi-rigid foam is advantageous in several respects. For example, the relatively soft nature of the foam allows the straps 97–99 to compress or "cut into" the uprights 112 and 113 and thereby inhibit movement of the uprights 112 and 113 relative to the straps 97–99. Also, because foam is a relatively light weight material, less support is required to maintain an upright in a substantially vertical orientation. Moreover, the softness and light weight of foam minimizes any potential discomfort to the skier and also minimizes the costs of packing and shipping the device. Furthermore, molded foam is also appealing because it is relatively convenient and inexpensive for manufacturing purposes.

Figure 2:
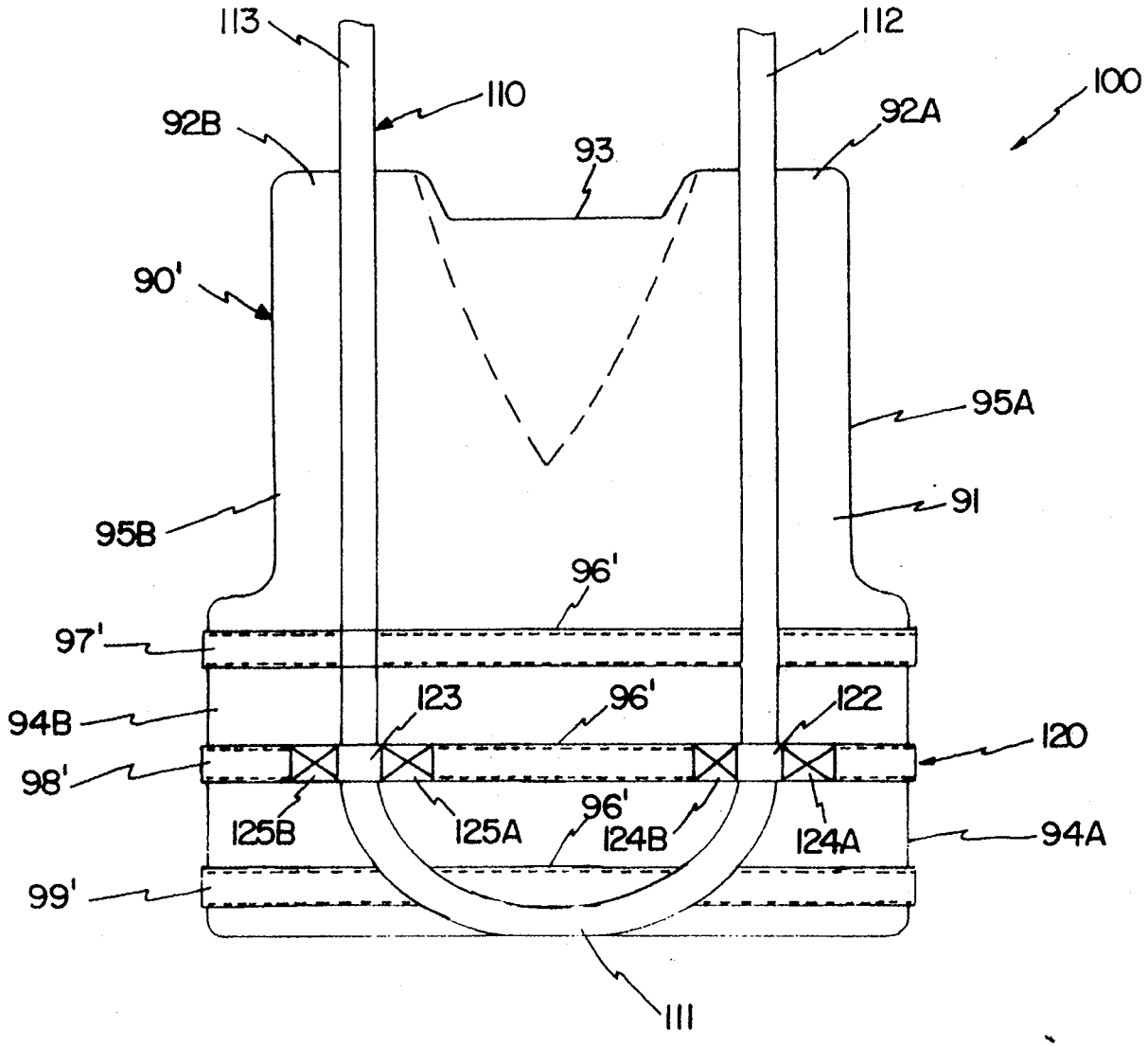
FIG. 2 is a rear view of another signal device constructed according to the principles of the present invention.

Another embodiment of the present invention is designated as 100 in FIG. 2. In this second embodiment 100, the same U-shaped member 110 is secured to another conventional vest 90'. The vest 90' has lateral straps 97'–99' similar to the lateral straps 97–99 on the conventional vest 90 shown in FIG. 1, but joined to the vest 90' by a different securing means 96'. In this case, the lateral straps 97'–99' are sewn along their length to the vest 90', and thus, the uprights 112 and 113 cannot simply be inserted between the vest back 91 and the straps 97'–99'. In all other respects, this second conventional vest 90' is similar to the first conventional vest 90. In this second embodiment 100, the middle strap 98' forms part of the means 120 for securing the U-shaped member 110 to the otherwise conventional vest 90'. Each of a pair of strap segments 122 and 123 has opposite end portions that are sewn (stitching is designated as 124*a–b* and 125*a–b*, respectively) to discrete portions of the middle strap 98'. The strap segments 122 and 123 are made of the same material as the lateral straps 97'–99'. An intermediate portion of each of the strap segments 122 and 123 cooperates with a discrete portion of the strap 98' (intermediate the stitching) to define a closed loop therebetween. The right upright 112 is inserted through and retained within the right loop (formed by strap segment 122) by means of a relatively snug fit, and similarly, the left upright 113 is inserted through and retained within the left loop (formed by strap segment 123) by means of a relatively snug fit. A visibility enhancing means similar to that of the first embodiment 10 extends between the distal ends of the uprights 112 and 113 on the second embodiment 100.

The integral construction of the U-shaped member 110 contributes to the structural integrity of the upwardly extending members 112 and 113 and minimizes the number of modifications and/or adaptations that need be made to the conventional vest 90' in order to accommodate the present invention. In addition to interconnecting the uprights 112 and 113, the intermediate member 111 engages the skier's lower back and thereby provides a second stabilizing effect. Moreover, only a single lateral strap 98' on the conventional vest 90' must be modified (to include a pair of horizontally extending belt loops) in order to support the U-shaped member 110, An additional, optional modification (not shown) may be made to provide a vertically extending belt loop on the lower strap 99', which belt loop would be oriented like a conventional belt loop and would receive and retain a middle portion of the intermediate member 111 to further enhance structural integrity.

Figure 3:
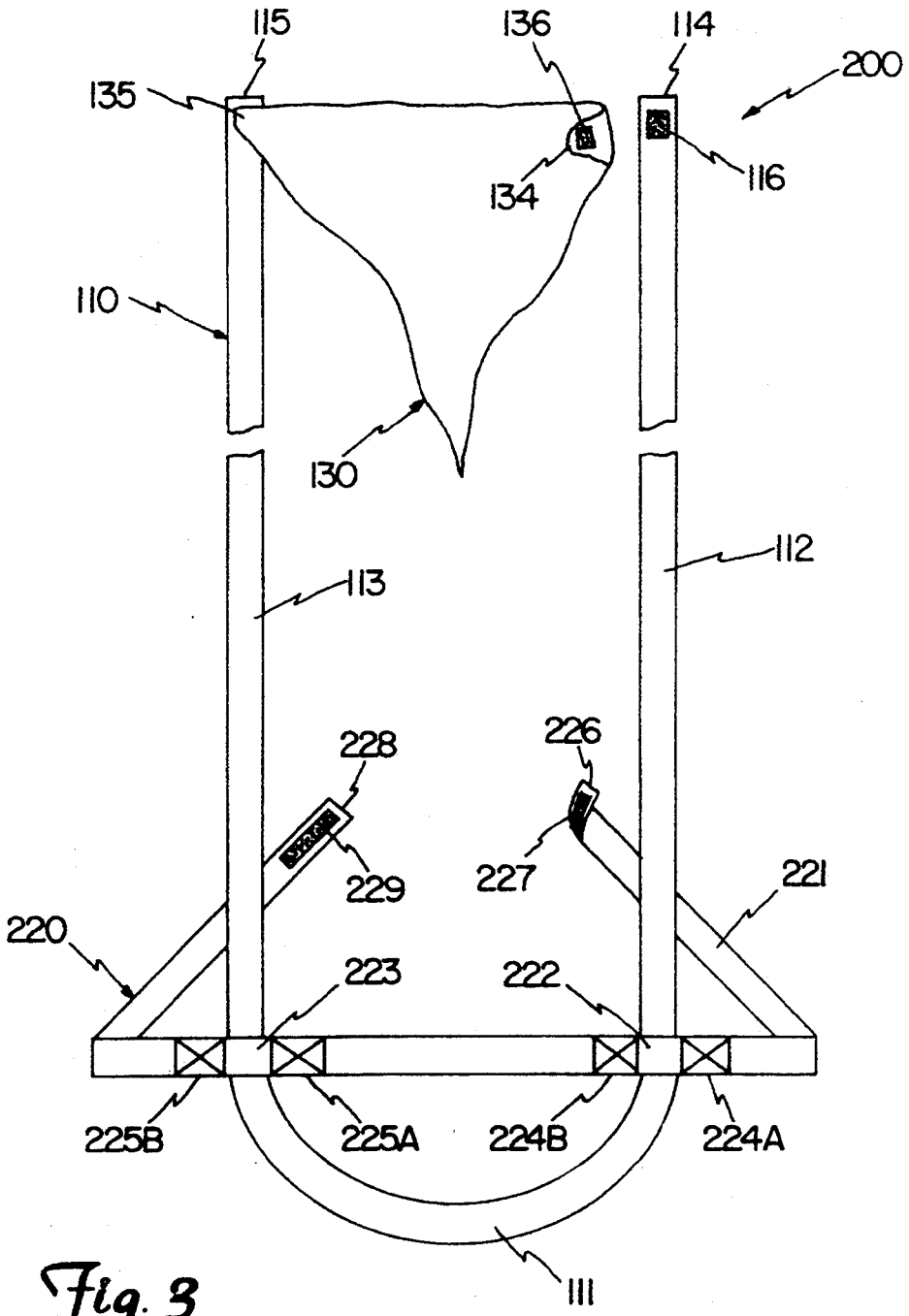
FIG. 3 is a rear view of another signal device constructed according to the principles of the present invention.

While the first embodiment 10 did not require any modifications to a particular type of conventional flotation device 90, a third embodiment of the present invention, which is designated as 200 in FIG. 3, does not require any modifications to conventional flotation devices of any kind. The signal device 200 generally includes a belt 220, which is similar to the belt 120 of the second embodiment 100, and the same U-shaped member 110 and visibility enhancing means 130 as on the first two embodiments 10 and 100. The distinguishing feature is that the belt 220, and hence the signal device 200, is not associated with or secured to a vest or any other type of flotation device. Thus, the signal device 200 may be secured about any type of flotation device or directly about a person's torso.

On this third signal device 200, the belt 220 includes an elongate strap 221 that extends between a first end 226 and a second end 228. Hook and loop fastener means 227 and 229 are disposed on the strap 221 proximate the ends 226 and 228 so that the strap 221 may be selectively formed into a closed loop about a person's waist or about a conventional vest, such as that designated as 90' in FIG. 2. Each of a pair of strap segments 222 and 223 has opposite end portions that are sewn (stitching is designated as 224*a–b* and 225*a–b*, respectively) to discrete portions of the elongate strap 221, intermediate the ends 226 and 228. An intermediate portion of each of the strap segments 222 and 223 cooperates with a discrete portion of the elongate strap 221 (intermediate the stitching) to define a closed loop therebetween. The first or right loop (formed by strap segment 222) receives and retains a first upwardly extending member 112 by means of a relatively snug fit, and the second or left loop (formed by strap segment 223) similarly receives and retains a second upwardly extending member 113 by means of a relatively snug fit.

The upwardly extending members' or uprights 112 and 113 extend from respective lower ends proximate the belt 220, to respective upper ends 114 and 115. The lateral member 111 extends between and integrally connects the lower ends of the uprights 112 and 113, and the visibility enhancing means 130 extends between the upper ends 114 and 115. In this embodiment 200, as well as the first two embodiments, the visibility enhancing means 130 is a flag that is secured to the upper ends 114 and 115 of the uprights 112 and 113, respectively, by means of hook and loop fasteners 116 and 136 (and others not shown) disposed on the uprights proximate the upper ends 114 and 115 and on two upper corners 135 and 136 of the flag 130.

The use of hook and loop fasteners allows interchangeability of flags according to factors such as the skill of the skier, the prevailing weather conditions, the tastes of the skier, and/or the skier's desire to make a particular statement, which could range from fashion to politics. In areas that are regulated in one manner or another, flags having different appearances may be used as a means of confirming (at a glance and from a distance) compliance with regulations. For example, in order to limit traffic on the water at any one time, different color flags can be distributed to different groups of people, and only select colors may be present in a given period of time.

Figure 4:
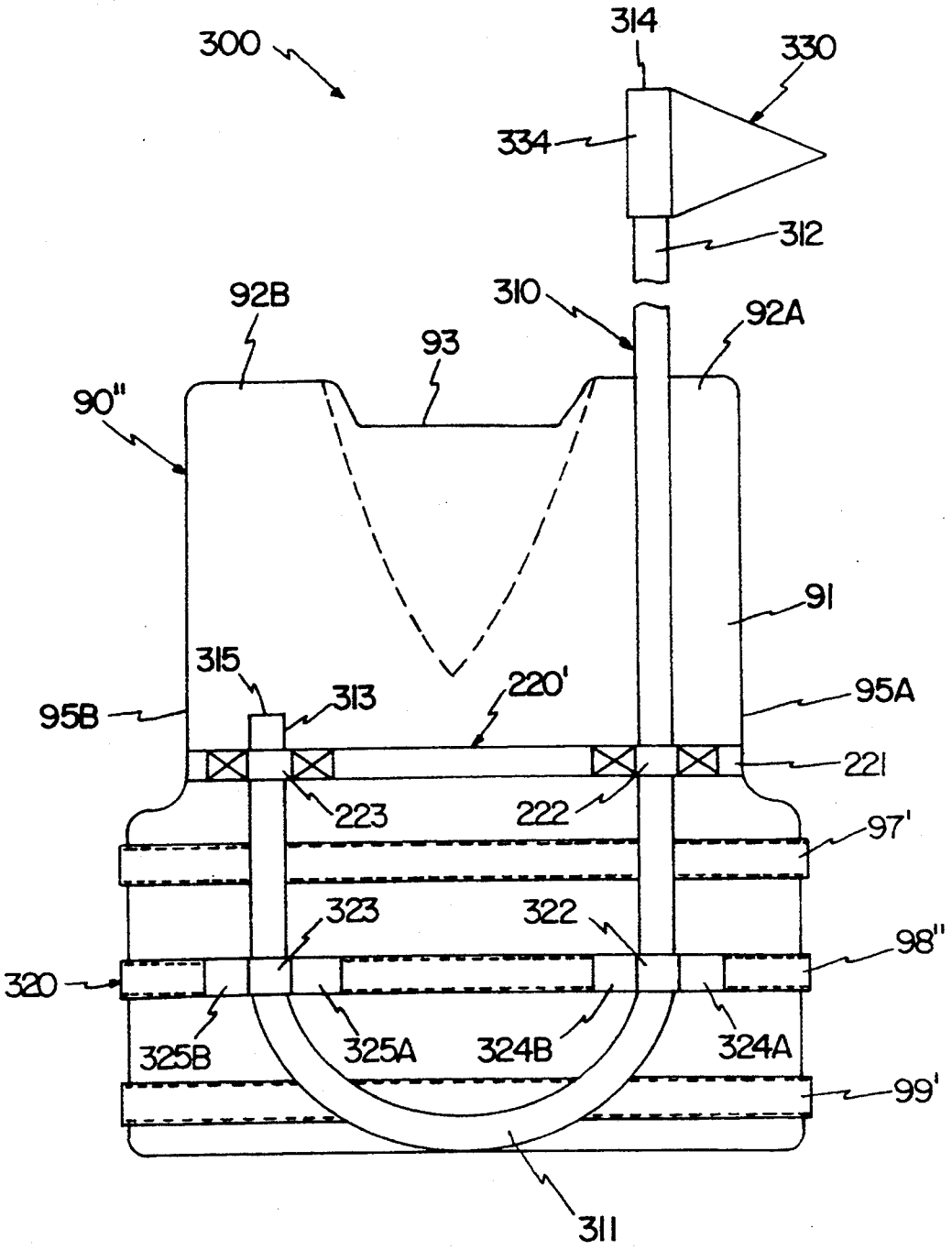
FIG. 4 is a rear view of another signal device constructed according to the principles of the present invention.
Figure 5:
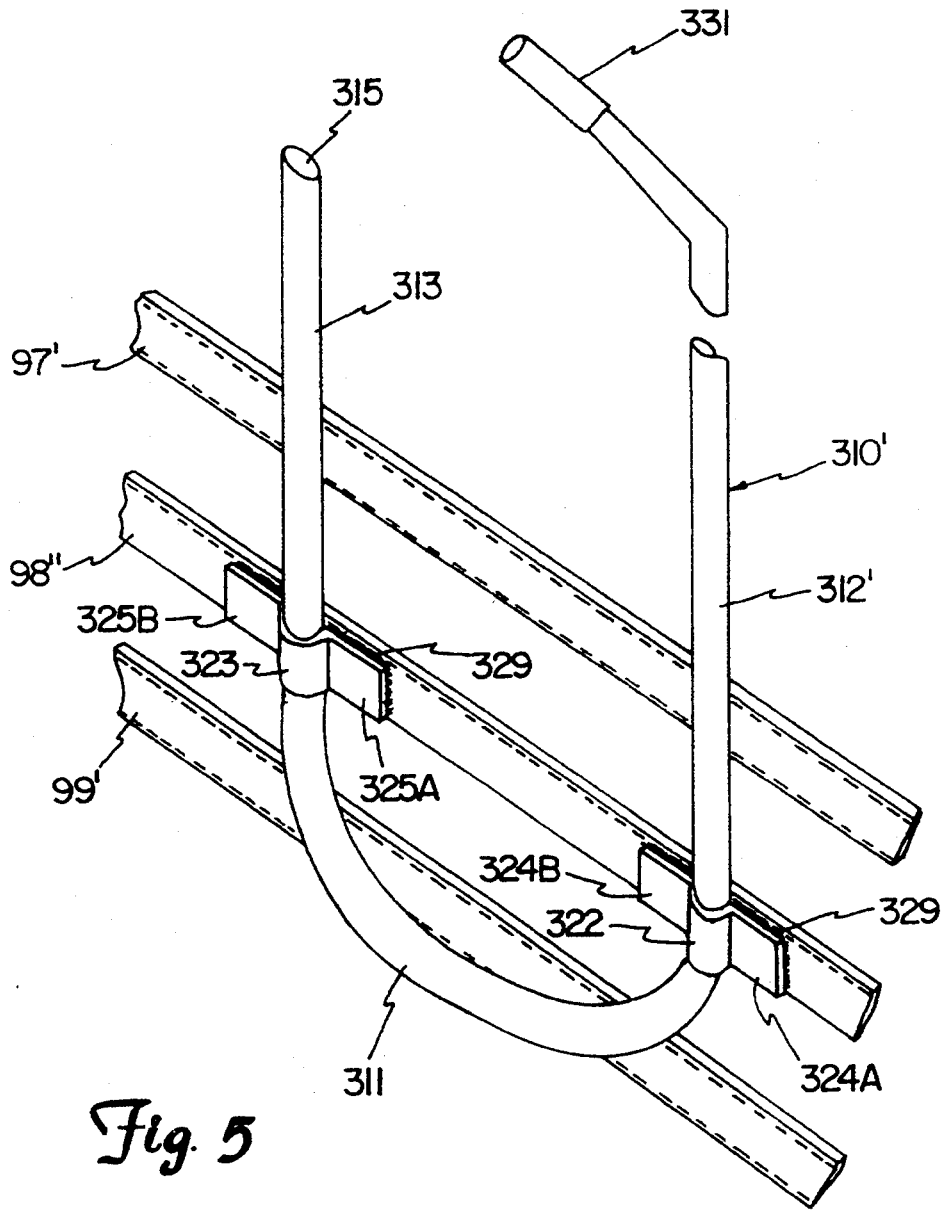
FIG. 5 is a perspective view of part of the signal device shown in FIG. 4, but with an alternative configuration of the upright and visibility enhancing means secured thereto.

A fourth embodiment of the present invention is designated as 300 in FIG. 4. The signal device 300 includes a substantially J-shaped member 310 having an arcuate member 311 integrally connected at one end to a first, relatively long upright 312, and integrally connected at an opposite end to a second, relatively short upright 313. The J-shaped member 310 is secured to an otherwise conventional vest 90" that is similar to the vest 90' described with reference to the second embodiment 100. The only difference between the vest 90" and the vest 90' is the presence of hook and loop fastener means 329 on discrete portions of the middle strap 98" which mate with hook and loop fastener means 329 on opposite ends of strap segments 322 and 323, as shown in FIG. 5. The mating hook and loop fastener means 329 provide an alternative means for securing the strap segments to the belt 320 in order to form the loops that retain the uprights 312 and 313.

As shown in FIG. 4, a belt 220' is secured around the back portion 91 of the vest 90" at the lower ends of the arm openings 95*a* and 95*b*. The belt 220' is similar to the belt 220 that is shown in and described above with reference to FIG. 3. Thus, the belt 220' includes a pair of strap segments 222 and 223 which are sewn to a strap 221 to form a pair of closed loops on the belt 220'. In combination, the belt 220' and the belt 320 cooperate with the J-shaped member 310 to provide an extra sturdy means for securing the upright 312 to the vest 90". Those skilled in the art will recognize that this embodiment would function equally well with a U-shaped member having two equally long uprights. In either case, each of the uprights 312 and 313 is secured to the vest 90" at two discrete locations and interconnected by the lateral member 311, as well.

Figure 6:
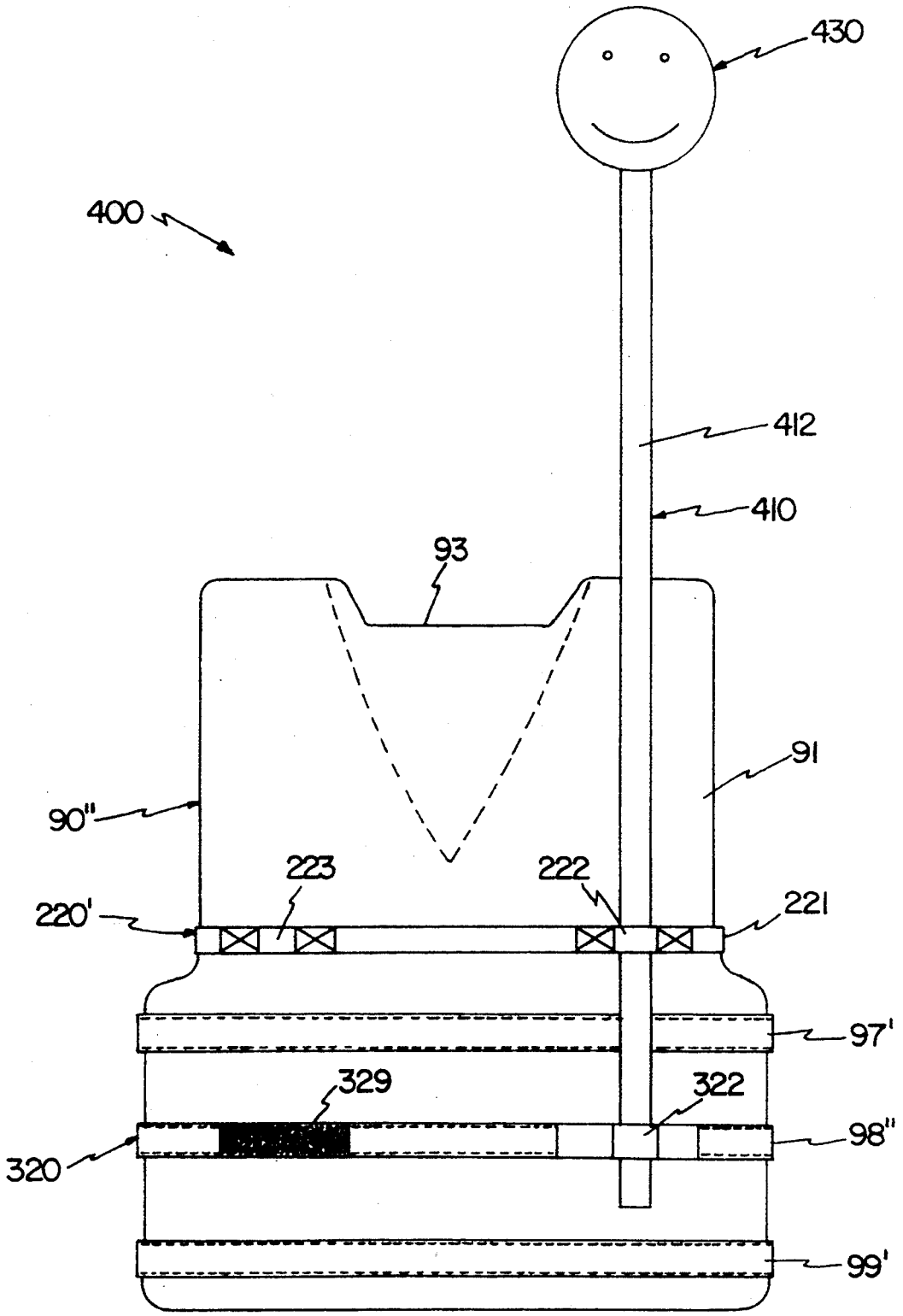
FIG. 6 is a rear view of another signal device constructed according to the principles of the present invention.
Figure 8:
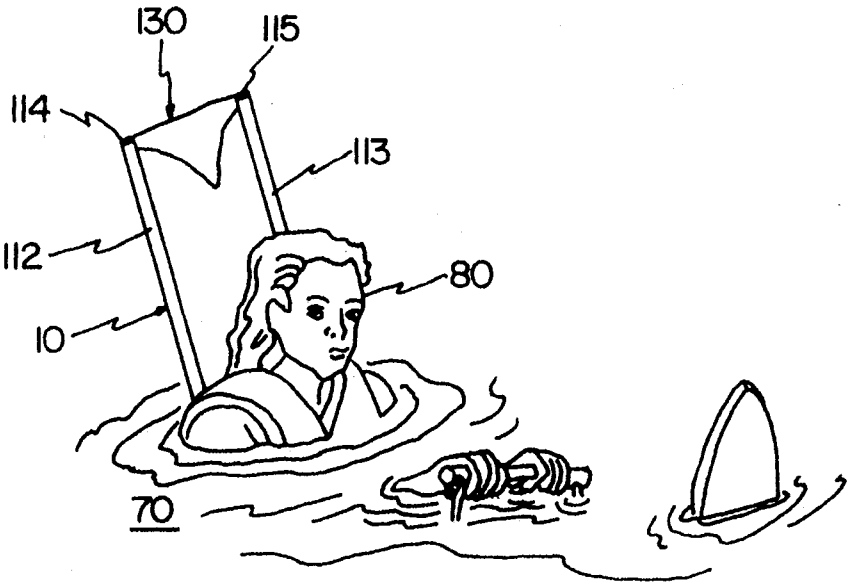
FIG. 8 is a perspective view of a water skier up on the water and wearing another signal device constructed according to the principles of the present invention.

The provision of two belts, together with a foam upright, reduces the need for two uprights and a lateral member extending therebetween. As shown in FIG. 6, a fifth embodiment 400 includes a substantially linear member 410 that provides a single upright 412 extending upward behind and above the right shoulder of the vest 90". A first belt 320 includes a loop, formed by means of hook and loop fastener on the belt 98" and a strap segment 322, which receives and retains a lower portion of the upright 412. A second belt 220' includes a loop, formed by means of stitching a strap segment 222 to the strap 221, which receives and retains a relatively higher portion of the upright 412. The two vertically spaced points of connection cooperate to reliably secure the upright 412 to the otherwise conventional vest 90". Recognizing that the vest 90 (described with reference to the first embodiment 10) has a plurality of vertically spaced belts 97–99, another embodiment 500, which is shown in FIG. 8, combines the upright 412 shown in FIG. 6 with the vest 90 shown in FIG. 1 to arrive at a particularly cost effective version of the present invention.

With reference back to FIG. 4, the visibility enhancing means 330 on the fourth embodiment 300 is a flag having a sleeve portion 334 designed to fit snugly over the distal end 314 of the upright 312. Obviously, the flag 330 could be secured to the upright 312 by other means, including hook and loop fasteners, and conversely, on the preferred embodiment, the flag 130 could include sleeve portions that fit snugly over the uprights 112 and 113. Although the hook and loop fasteners may be easier to use, the sleeves require fewer materials and steps in manufacture and provide a different look, as well.

An alternative J-shaped member, which is designated as 310' in FIG. 5, has only a sleeve 331 as its visibility enhancing means. Other variations of visibility enhancing means include a pom-pom, such as that designated as 530 in FIG. 8; an ornament, such as that designated as 430 in FIG. 6; or merely coloring the uprights or the entire J-shaped or U-shaped member.

With reference back to FIG. 5, the upper end of the upright 312' is disposed at an angle relative to the remainder of the upright 312' to emphasize that the meaning of the term "upright" is not limited to linear and/or vertical members. Rather the term should be construed to include any member that extends in some fashion or another from a lower portion secured to the back of a skier or flotation device to a relatively higher portion disposed above a shoulder of the skier or flotation device. In order for the present invention to be effective, the distance between the lower portion and the upper portion must be at least two feet and is closer to three feet in a preferred embodiment. So long as this minimum length requirement is met, angling of the uprights may be preferred because it places the uprights farther away from the skier's head and farther beyond his or her range of peripheral vision.

The upright portion of the present invention may be manufactured by methods other than molding a U-shaped or J-shaped member. For example, a U-shaped member may also be constructed by manipulating a single, substantially linear piece of semi-rigid foam into the shape shown in FIG. 1. In this mode of construction, a first end of an elongate member is inserted through the first loop in the belt on the signal device, thereby defining a first distal length between the first loop and the first end. Then, a second, opposite end of the elongate member is inserted through a second loop in the belt on the signal device, thereby defining a second distal length between the second loop and the second end, and also defining an intermediate length between the first loop and the second loop. Next, the intermediate length is adjusted so that the first distal length is substantially equal to and extends substantially parallel to the second distal length. Finally, a visibility enhancing means is secured to at least one of the first end and the second end. The otherwise straight, elongate piece of foam can be distributed in a package that retains the piece in the desired U-shape, or perhaps in a teardrop shape with the distal ends touching, not only to reduce the overall size of the package, but also to encourage the foam to remain in the desired U-shape when it is removed from the packaging.

The present invention has been described with reference to specific embodiments, methods, and applications. However, those skilled in the art will recognize additional embodiments, methods, and applications that fall within the scope of the present invention. Accordingly, the present invention is to be limited only by the appended claims.

What is claimed is:

1. A device of a type worn by a person, comprising:
a transverse member;
a first upwardly extending member integrally connected to said transverse member;
a second upwardly extending member integrally connected to said transverse member;
a securing means for securing the device to the person in such a manner that said first upwardly extending member extends upward above a shoulder of the person and to one side of the person's head, and said second upwardly extending member extends upward above an opposite shoulder of the person and to an opposite side of the person's head;
and a visibility enhancing means, mounted on an upper end of at least one of said first and second upwardly extending members, for enhancing visibility of the person to whom the device is secured.

2. A device according to claim 1, wherein said visibility enhancing means includes a sleeve that fits snugly over said upper end of said at least one of said upwardly extending members, for enhancing visibility of the person wearing the device.

3. A device according to claim 1, wherein said visibility enhancing means is mounted on said upper end of said at least one of said upwardly extending members by means of hook and loop fasteners, for enhancing visibility of the person wearing the device.

4. A device according to claim 1, wherein said first and second upwardly extending members extend substantially parallel to one another.

5. A device according to claim 1, further comprising a flag that extends between upper ends of said first and second upwardly extending members.

6. A device according to claim 1, wherein said transverse member extends between a first end and a second end, and a lower end of said first upwardly extending member is integrally connected to said first end, and a lower end of said second upwardly extending member is integrally connected to said second end.

7. A device according to claim 1, wherein said securing means includes a belt of a type that selectively forms a closed loop, and said first upwardly extending member is secured to a right rear portion of said belt, and said second upwardly extending member is secured to a left rear portion of said belt.

8. A device according to claim 7, wherein said securing means further includes a right strap and a left strap, and said first upwardly extending member is disposed between said right strap and said right rear portion of said belt, and said second upwardly extending member is disposed between said left strap and said left rear portion of said belt, and opposite ends of said right strap are sewn to said belt, and opposite ends of said left strap are sewn to said belt.

9. A device according to claim 7, wherein said securing means further includes a right strap and a left strap, and said first upwardly extending member is disposed between said right strap and said right rear portion of said belt, and said second upwardly extending member is disposed between said left strap and said left rear portion of said belt, and opposite ends of said right strap are secured to said belt by means of hook and loop fasteners, and opposite ends of said left strap are secured to said belt by means of hook and loop fasteners.

10. A signal device according to claim 7, wherein said securing means includes a flotation vest of a type worn by water skiers, and said belt is secured laterally about a portion of said flotation vest.

11. A signal device of a type worn by a person while engaging in a water activity, comprising:
a substantially U-shaped member having a transverse member that integrally interconnects a lower end of an upwardly extending member to a lower end of another, similar upwardly extending member;
a securing means for securing said substantially U-shaped member relative to a person's back in such a manner that said upwardly extending member extends upward above one of the person's shoulders and above and to one side of the person's head, and said another upwardly extending member extends upward above an opposite shoulder of the person and above and to an opposite side of the person's head; and visibility enhancing means, mounted on an upper end of at least one of said upwardly extending members, for enhancing visibility of the person.

12. A signal device according to claim 11, wherein said substantially U-shaped member is made of semi-rigid foam.

13. A signal device according to claim 11, wherein said securing means includes a belt of a type that selectively forms a closed loop, and said upwardly extending members are secured to discrete portions of said belt.

14. A signal device according to claim 11, wherein said upwardly extending members extend from respective lower ends to respective upper ends, and a flag extends between and thereby interconnects said respective upper ends.

15. A device according to claim 1, wherein said transverse member and said upwardly extending members are integral portions of a single piece of semi-rigid foam.

16. A signal device according to claim 14, wherein said securing means includes a belt that extends substantially linearly between and thereby interconnects said respective lower ends.

17. A signal device according to claim 11, wherein said securing means includes a belt that extends substantially linearly between and thereby interconnects said lower ends, and said transverse member extends in an arc between said lower ends.

18. A method of making a signal device of a type having a belt and worn by a person while engaging in a water activity, comprising the steps of:

inserting a first end of an elongate semi-rigid member through a first loop in the belt, thereby defining a first distal length between the first loop and the first end;

inserting a second end of an elongate semi-rigid member through a second loop in the belt, thereby defining a second distal length between the second loop and the second end, and thereby defining an intermediate length between the first loop and the second loop; and adjusting the intermediate length so that the first distal length and the second distal length extend upward above and to opposite sides of the person's head; and attaching visibility enhancing means to at least one of said first and second ends.

19. A method according to claim 18, wherein the adjusting step further involves adjusting the intermediate length so that the first distal length and the second distal length extend substantially parallel to one another.

20. A method according to claim 18, wherein the adjusting step further involves adjusting the intermediate length so that the first distal length and the second distal length are approximately equal to one another.

* * * * *